United States Patent [19]

Füssner et al.

[11] Patent Number: 4,516,729

[45] Date of Patent: May 14, 1985

[54] FUEL INJECTION NOZZLE FOR INTERNAL COMBUSTION ENGINES

[75] Inventors: Paul Füssner, Sindelfingen; Karl Hofmann, Remseck; Iwan Komaroff, Regensburg; Katsuoki Itoh, Leonberg; Kurt Seifert, Esslingen; Dietrich Trachte, Kornwestheim; Wilhelm Vogel, Stuttgart; Hans-Jörg Vogtmann, Markgröningen, all of Fed. Rep. of Germany

[73] Assignee: Robert Bosch GmbH, Stuttgart, Fed. Rep. of Germany

[21] Appl. No.: 421,195

[22] Filed: Sep. 22, 1982

[30] Foreign Application Priority Data

Dec. 12, 1981 [DE] Fed. Rep. of Germany ..... 3149276

[51] Int. Cl.[3] ..... B05B 1/32

[52] U.S. Cl. ..... 239/453; 239/533.9; 239/533.12

[58] Field of Search ..... 251/65; 239/533.2–533.12, 453

[56] References Cited

U.S. PATENT DOCUMENTS 2,749,181 6/1956 Maxwell et al. ..... 251/65
4,344,575 8/1982 Seifert ..... 239/533.5

FOREIGN PATENT DOCUMENTS 2711392 9/1978 Fed. Rep. of Germany ... 239/533.9
2093912 9/1982 United Kingdom ..... 239/533.9

*Primary Examiner*—Jeffrey V. Nase
*Assistant Examiner*—Jon M. Rastello
*Attorney, Agent, or Firm*—Edwin E. Greigg

[57] ABSTRACT

A fuel injection nozzle for internal combustion engines having a valve needle which enters an intermediate position in a retarded fashion and subsequently reaches its final position quickly. The valve needle is coupled in a positively-engaged manner with a supplementary body which as a result of its mass and/or hydraulically damps the movement of the valve needle over the course of a first stroke portion. At the end of this stroke portion, the supplementary body strikes a shoulder attached to the housing, whereupon the valve needle after the attainment of a notably higher fuel pressure, is separated from the supplementary body and translated quickly into its open position. In special cases, it is also possible for two supplementary bodies to be provided, which are uncoupled one after another from the valve needle and then again recoupled to the valve upon the closure of the valve. With an apparatus of this kind, the injection procedure can be adapted more freely than in the case of the known injection nozzles to a desired course.

14 Claims, 8 Drawing Figures

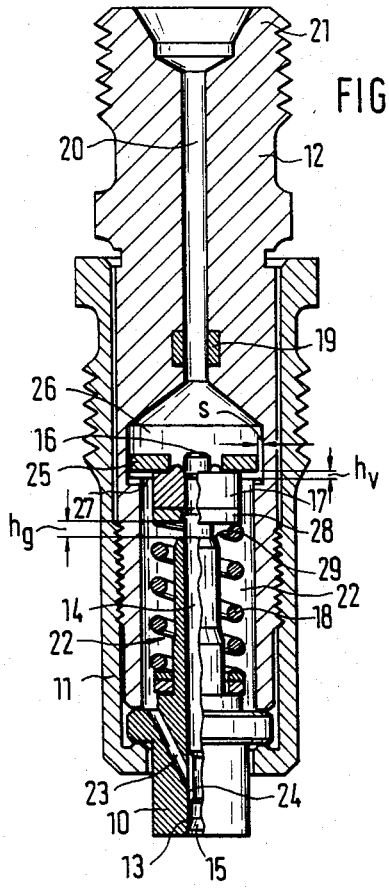
FIG.1
FIG.1A
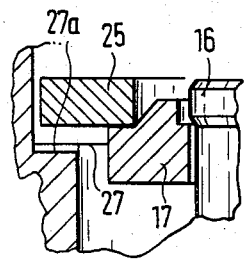
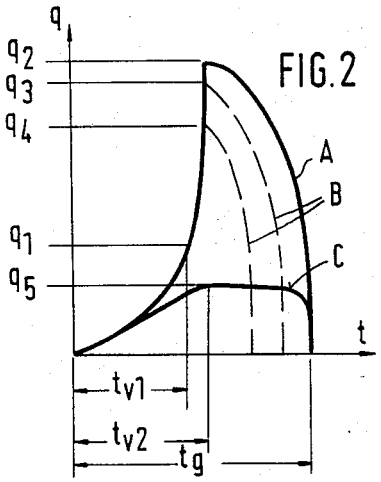
FIG.2
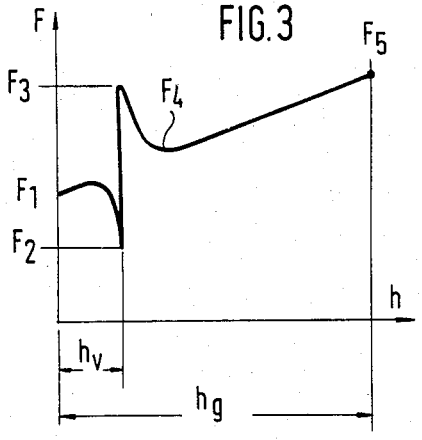
FIG.3

FUEL INJECTION NOZZLE FOR INTERNAL COMBUSTION ENGINES

BACKGROUND OF THE INVENTION

The invention is based on an injection nozzle for internal combustion engines. In such injection nozzles, the course of injection has a first phase in which a preliminary injection of fuel is effected. In this first phase, the valve closing member executes its first stroke portion. Directly following the first phase is a second phase, corresponding to the second stroke portion of the valve closing member, in which the primary quantity of fuel is injected. The intention is to prolong the first phase to the greatest possible extent in order to improve idling and partial-load behavior, and to cause the valve closing member to return as rapidly as possible to its final position in the second phase, so that the primary fuel quantity can be injected quickly and completely. Upon the closure of this valve, the valve closing member should at first move rapidly back, but then be braked in good time so that shocks are avoided when the valve arrives at its valve seat.

In a known injection nozzle of this general type (Swiss patent No. 329 505, FIG. 4), the supplementary body is embodied by a support disk, which is displaceably disposed upon the valve closing member, which is embodied as a valve needle. The support disk is pressed by a supplementary spring against an annular collar of the valve needle, which acts in the opposite direction from the closing spring. At the end of the first stroke portion, the support disk strikes the stop attached to the housing in a form-locking manner, and the stop thereupon absorbs the supplementary spring force. During the second stroke portion, the force of the closing spring is thereby exerted completely against the valve needle. In this embodiment, it is true that an abrupt change is attained in the opening pressure or in the course of the valve return at the end of the first stroke portion of the valve closing member. However, it is disadvantageous that the two springs must be carefully matched to one another and that opportunities for exerting influence upon the course of injection are still limited.

OBJECT AND SUMMARY OF THE INVENTION

The apparatus according to the invention has the advantage over the prior art that the force exerted by the supplementary body on the valve closing member no longer influences the closing force per se but rather substantially influences the magnitude of the opening pressure jump at the beginning of the second stroke portion. As a result, the injection process can be more frequently adapted to the desired course than is the case with the known apparatus.

By means of the characteristics disclosed, advantageous further developments of the apparatus disclosed in the main claim are possible.

The jump in pressure in the course of the opening pressure can be limited in terms of time if the supplementary body is uncoupled from the valve closing member in the second partial-stroke range.

The supplementary body may be coupled with the valve closing member by mechanical detent means, for example. In that case the movable detent member may be displaceably guided on the supplementary body or on the valve closing member and may cooperate with a detent shoulder of the other part.

One simple and wear-free embodiment is attained if the supplementary body is coupled with the valve closing member by magnetic force, which can preferably be provided by a permanent magnet body.

In the simplest case, the supplementary body may itself be embodied as a permanent magnet body.

However, further advantageous embodiments are attained if the permanent magnet body is secured to the supplementary body or to the valve closing member or is embedded in one of these elements.

In that case, as disclosed in claim 7, the supplementary body may be embodied as a hydraulic damping member and/or, in accordance with claim 9, as a supplementary mass. In some cases it may be advantageous to provide a plurality of supplementary bodies as defined by claim 10, which are uncoupled from the valve closing member one after another and are then recoupled with the valve closing member upon the closure of the valve. The apparatus may also be arranged such that the speed-dependent or acceleration-dependent damping effect of the appropriately supported and/or embodied supplementary body overcomes the holding force the supplementary body temporarily exerts on the valve closing member at the end of the first or second stroke portion or makes this holding force entirely dispensable. In that case, the means for releasable coupling of the supplementary body to the valve closing member need be embodied and dimensioned only such that they prevent a premature release of the elements caused by the damping effect and/or by the inertial sluggishness.

When the supplementary body is embodied as a hydraulic damping member and as a massive body, it is advantageous to couple the supplementary body to the valve closing member as early as at the onset of the opening movement or shortly thereafter.

A further opportunity of adapting the course of injection optimally to given conditions may be attained. Upon closure of the valve, these characteristics result in an abrupt jump in force, in the course of which the closing movement is accelerated still more.

If the magnetic system is provided with an initial air gap, then shocks occurring as the valve member arrives upon the valve seat can be effectively suppressed even in unfavorable cases.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 shows a sectional view of an injection nozzle according to the first exemplary embodiment;

FIG. 1*a* shows a detail of FIG. 1 on an enlarged scale;

FIG. 2 shows the fuel quantity diagram of this embodiment, and

FIG. 3 shows the force diagram of the injection nozzle of FIG. 1;

DESCRIPTION OF THE EXEMPLARY EMBODIMENTS

Figure 4:
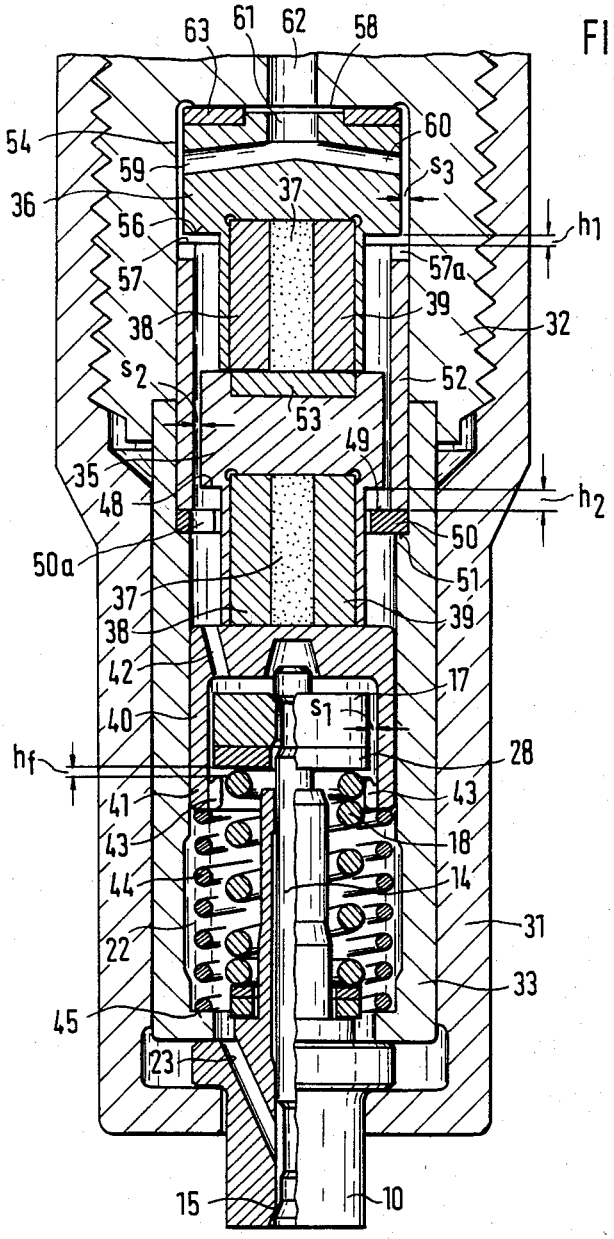
FIG. 4 shows the second exemplary embodiment in section.

The injection nozzle of FIG. 1 has a nozzle body 10, which is firmly clamped onto a nozzle holder 12 by a sleeve nut 11. A valve seat 13 opening toward the outside is formed in the nozzle body 10, and a valve needle 14 is displaceably guided in the nozzle body 10, being provided on its end toward the combustion chamber with a sealing cone 15. At the other end, the valve needle 14 has a head 16, on the lower annular shoulder of which a support disk 17 rests. The support disk 17 is engaged by a closing spring 18, which tends to displace the valve needle 14 upward until the sealing cone 15 comes to rest on the valve seat 13. The nozzle holder 12 includes an inflow bore 20, which leads from a connection fitting 21 into a chamber 22 in which the closing spring 18 is disposed. An oblique bore 23 in the nozzle body 10 leads from the chamber 22 into an annular chamber 24 forming between the wall of the guide bore for the valve needle 14 and the nozzle body 10 and an annular groove in the valve needle 14, preceding the valve seat 13.

The support disk 17 is made of soft iron and it carries a disk-like supplementary body 25 of permanent-magnetic material, which adheres to the support disk 17 with a predetermined holding force. The supplementary body 25 is guided with a predetermined radial play s in a widened section 26 of the chamber 22, which merges at a shoulder 27 with the non-widened section of the chamber 22. The flat annular face of the shoulder 27 is interrupted by a multiplicity of recesses 27*a*, the purpose of which will be described later. The lower side of the supplementary body 25, in the illustrated closing position of the valve 13, 15 is remote by a distance $h_v$ from the shoulder 27, which corresponds to a first stroke portion of the valve needle 14. The support disk 17 is covered on its underside by a disk 28 of nonmagnetizable material, which in the illustrated closing position of the valve is at a distance $h_v$ from an end shoulder 29 of the nozzle body 10, this distance corresponding to the total stroke of the valve needle 14.

The described injection nozzle functions as follows:

At the beginning of one injection procedure, the fuel pressure in the chamber 22 increases until it is capable of overcoming the force of the closing spring 18 and displacing the valve needle outward. The valve 13, 14 thus opens, so that fuel can be ejected from the chamber 22 via the bore 23, the annular chamber 24, and the valve opening.

FIG. 2 gives a fuel quantity diagram for the described injection nozzle. In the diagram, the quantity of fuel q ejected per unit of time is plotted over the injection time t. The curve A corresponds to full-load operation. The curves B correspond to partial-load operation and curve C corresponds to idling operation. In FIG. 3 the closing force diagram of the described injection nozzle is shown. In this diagram, over the stroke h of the valve needle 14, the resultant force F is plotted, which is the product of the force of the closing spring 18, the magnetic forces existing between the supplementary body 25 and the support body 17 on the one hand and the supplementary body 25 and the nozzle holder 12 on the other, and the hydraulic damping of the supplementary body 25 in the bore section 26.

The functioning of the described injection nozzle will now be described with the aid of FIGS. 1–3:

At the onset of one injection procedure, substantially only the force of the closing spring 18 is exerted upon the valve needle 14, this force being only slightly weakened by the attracting force of the supplementary body 25 exerted upon the shoulder 27 of the nozzle holder 12. The initial force resulting from these two forces is indicated in FIG. 1 as $F_1$. When the fuel pressure overcomes the force $F_1$, the valve needle 14 is first displaced downward in the opening direction by the stroke portion $h_v$, which will hereafter be described as the pre-stroke, until the supplementary body 25 strikes against the shoulder 27. The force of the closing spring 18 thereby slightly increases, but the increase is more than compensated for by the increasing magnetic attracting force between the supplementary body 25 and the shoulder 27. As a result, the resultant closing or displacement force at the end of the pre-stroke $h_v$ drops to the value $F_2$.

In full-load and partial-load operation, the fuel pressure continues to increase, and the valve needle 14 is at first prevented from moving further by the supplementary body 25. However, once the fuel pressure has attained the value $F_3$, it overcomes the magnetic holding force existing between a supplementary body 25 and the support disk 17 or the valve needle 14 and the counteracting force of the closing spring 18, so that the valve needle 14 is torn from the supplementary body 25. Subsequently the valve needle 14 is abruptly translated into the opening position by the amount of the distance $h_g - h_v$. The severe drop in magnetic attracting force temporarily outweighs the linear increase in closing spring force, so that as may be seen from FIG. 3 the resultant course of the closing force characteristic curve first drops to the value $F_4$ and then once again increases to the value $F_5$. The hydraulic damping of the supplementary body 25 has no further effect in the second stroke portion of the valve needle 14.

Upon the attainment of the fully open position of the valve needle 14 and the subsequent drop in fuel pressure, the valve needle 14 is moved rapidly back into the closing position, the magnetic attracting force of the supplementary body 25 further accelerating this movement. Shortly before the closed position is attained, the support disk 17 arrives at the supplementary body 25, and subsequently the remaining movement takes place damped both hydraulically and, because of the magnetic field existing between the supplementary body 25 and the nozzle holder 12, magnetically as well. In this manner, an overly hard seating of the valve needle 14 upon the valve seat 15 and shocks at the valve needle 14 are prevented.

The length of time in which the valve needle 14 drops the distance of the pre-stroke $h_v$ and the fuel pressure then increases up to the value $F_3$ depends not only upon the parameters of the injection nozzle itself but also on the rpm and the load setting of the injection pump. During full-load and partial-load operation, the time $t_v1$ as shown in FIG. 2 is required for this purpose. A fuel quantity is thereby transmitted which corresponds to the area below the curve A between $t=0$ and $t=t_v1$. After the supplementary body 25 comes to rest on the shoulder 27, the fuel flows downstream of the gap s through the recesses 27*a*, and the quantity of fuel allowed to pass therethrough per unit of time increases to the value $q_1$. After the valve needle 14 has been torn away from the supplementary body 25, the throughput fuel quantity per unit of time increases abruptly, attaining the value $q_2$ at full-load operation and a lesser value $q_3$ or $q_4$ during partial-load operation. From this top threshold value, the throughput fuel quantity per unit of time drops to a value of 0 over the course of the closing stroke of the valve needle 14, which is rapidly executed. The total throughput fuel quantity during this primary phase of the injection procedure corresponds to the area below the curve A or the one of the curves B between $t=t_v1$ and $t=t_g$. During idling operation, the fuel pressure rises, at most, only up to a threshold value which is less than the value $F_3$. In that case the valve needle 14 is not torn away from the supplementary body 25, and its total stroke remains restricted to the length of the pre-stroke $h_v$. However, the return movement into the closed position is again hydraulically damped as well as magnetically because of the magnetic field existing between the supplementary body 25 and the nozzle holder 12. The supplementary body 25, after the time $t_v2$ has elapsed, strikes against the shoulder 27, whereupon the fuel proceeds to the nozzle opening only via the recesses 27*a*. The throughput fuel quantity per unit of time attains only the value $q_5$, and the total throughput quantity during one injection procedure corresponds to the area below the curve C between $t=0$ and $t=t_g$. It may be seen from FIG. 2 that this fuel quantity is substantially smaller than the throughput fuel quantity during full-load or partial-load operation.

The fuel injection pump according to FIG. 4 also has a prefabricated assembly comprising a nozzle body 10, a valve needle 14 with a support disk 17, a disk 28 and a closing spring 18, the assembly being clamped firmly to a nozzle holder 32 by a sleeve nut 31. The nozzle body 10 is supported on one end face of a bushing 33, the other end face of which rests on the nozzle holder 32. In this injection nozzle, two supplementary bodies 35 and 36 are provided, which are embodied as mass bodies and are movable in a hydraulically damped manner; during the opening stroke of the valve needle 14, these supplementary bodies 35 and 36 are uncoupled in sequence from the valve needle and then recoupled to the valve needle again in reverse order during the closing stroke of the valve needle 14. Each supplementary body 35, 36 includes a permanent magnet body 37 realized in a flat shape, on each flat side of which one segment-like pole body 38 or 39, of soft iron, is secured. The bodies 37, 38 and 39 together form a cylindrical magnet component which is molded into the supplementary body 35 or 36, which itself is of nonmagnetizable material.

The supplementary body 35 is seated with its magnetic component 37, 38, 39 on a cup-like coupler 40 of soft iron, which is displaceably guided in the bushing 33 and with its jacket surrounds and engages the support disk 17 and the disk 28 located below it with a predetermined amount of radial play $s_1$. The coupler 40 is provided with an inwardly directed collar 41, which passes beneath the disk 28 and, in the illustrated outset position of the elements which will be described in greater detail later, is at a distance $h_f$ from the disk 28. In practice, the coupler 40 is realized in two parts, so that the parts can be combined. The base of the coupler 40 includes a bore 42; on the inside, the collar 41 is provided with a plurality of longitudinal grooves 43, distributed uniformly over the inner circumference, for the passage therethrough of the fuel. A helical spring 44 acts upon the coupler 40 and is supported at the bottom on an inner shoulder 45 of the bushing 33. The supplementary body 35 is provided on the jacket circumference with an annular shoulder 48, which in the illustrated outset position is at the distance $h_2$ from a counterpart shoulder 49 attached to the housing. This counterpart shoulder 49 is formed on a ring 50, which is seated on an annular shoulder 51 of the bushing 33 and is fitted firmly with a sheath 52 into the bushing 33. The ring 50 is provided on its inner rim with a plurality of recesses 50*a* distributed uniformly over the circumference for the passage therethrough of the fuel. The upper end face of the supplementary body 35 is provided with a disk 53 of soft iron, which serves as the armature for the magnet component 37, 38, 39 of the supplementary body 36. The supplementary body 35 is guided in the sheath 52 with a predetermined amount of radial play $s_2$, and the sheath 52 protrudes in a tightly fitted manner into a blind bore 54 of the nozzle holder 32.

The supplementary body 36 is provided on the jacket circumference with an annular shoulder 56, which in the illustrated outset position is at the distance $h_1$ from the upper end face 57, serving as a counterpart shoulder, of the sheath 52. The upper end face 57 of the sheath 52 is provided with a plurality of recesses 57*a*, distributed uniformly over the circumference, for the passage therethrough of the fuel. The outset position is predetermined in that on the one hand the valve needle 14 is pressed by the helical spring 18 against the valve seat 15 in the nozzle body 10 and on the other hand the supplementary body 36 is pressed by the helical spring 44 via the coupler 40 and the supplementary body 35 against the base 58 of the blind bore 54 in the nozzle body 32. The supplementary body 36 is guided in the blind bore 54 with a predetermined amount of radial play $s_3$. The blind bore 54 communicates via conduits 59, 60, 61 in the supplementary body 36 with a fuel inflow bore 62 in the nozzle holder 32. In order to damp impact, the supplementary body 36 is provided on its upper end face with an annular disk 63 of any suitable material.

Figure 5:
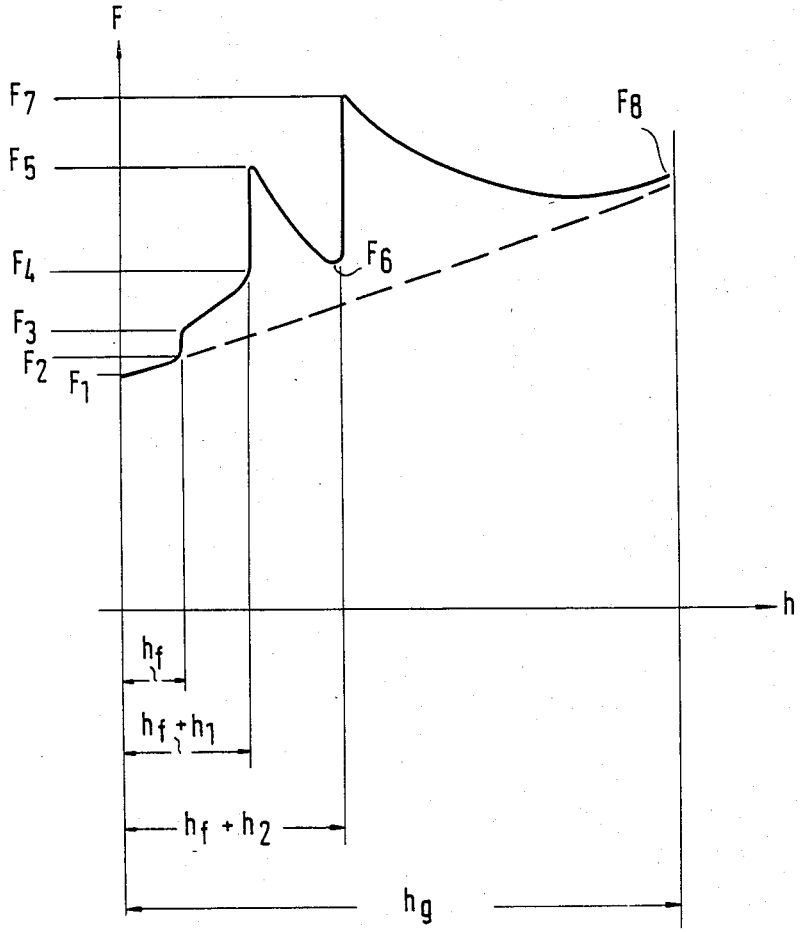
FIG. 5 shows the force diagram for this second exemplary embodiment.

The mode of operation of the injection nozzle shown in FIG. 4 will now be described with the aid of the closing force diagram of FIG. 5:

At the onset of one injection procedure, only the force of the closing spring 18, which is indicated in FIG. 5 by the symbol $F_1$, acts upon the valve needle 14. Once the increasing fuel pressure overcomes the force $F_1$, the valve needle 14 moves downward in the opening direction, this movement being effected in a damped manner because of the relatively small passageway cross section in the radial gap $s_1$. After the opening of the valve 14, 15, the supplied fuel passes through the annular gaps $s_3$, $s_2$, $s_1$, the recesses 57*a*, 50*a*, the bore 42 and the longitudinal grooves 43 into the chamber 22, from whence the fuel passes through the bore 23 in the nozzle body 10 to the ejection opening.

Following an idle stroke of the dimension of the distance $h_f$, the valve needle 14 strikes the coupler 40, the force of the closing spring 18 thereupon having increased to the value $F_2$. In this position of the valve needle 14, the force of the helical spring 44 is abruptly added to the force of the closing spring 18, so that a resultant total force $F_3$ is produced. The valve needle 14 together with the coupler 40 and the two supplementary bodies 35, 36 now moves downward by the amount of the stroke portion $h_1$, at the end of which the supplementary body 36 strikes against the shoulder 57. This stroke movement is damped in accordance with speed on the one hand, because of the hydraulic damping in the radial gaps $s_2$ and $s_3$, and in accordance with acceleration on the other hand, because of the relatively large masses of the two supplementary bodies 35, 36.

The greater the speed of pressure increase in the delivered fuel, the greater the damping effect will be. In other words, the damping is the greater, the higher the engine rpm. At the end of this stroke movement, the counteracting force of the two springs 18 and 44 has increased to the value $F_4$.

The fuel pressure, as it continues to increase, must now additionally overcome the magnetic holding force exerted by the blocked supplementary body 36 upon the following supplementary body 35. This eventually occurs when the fuel pressure exerts the force $F_5$ upon the valve needle 14. Subsequently, the supplementary body 36 is uncoupled, whereupon the valve needle 14 with the coupler 40 and the supplementary body 35 continue to move further in the opening direction, with lesser damping, to the extent of a further stroke portion having the length $h_2-h_1$. The closing force exerted on the valve needle 14 thereupon drops to the value $F_6$. Following this third stroke portion, the supplementary body 35 is uncoupled, in the manner already described, by increasing the opening pressure exerted by the fuel pressure to the value $F_7$, and the valve needle 14 rapidly moves further into the completely open position. Upon the closure of the valve, the events relating to the coupling of the two supplementary bodies 35, 36 to the coupler 40 take place in reverse order. The valve needle 14 itself is uncoupled, in this second phase of the injection procedure, from the masses of the elements 40, 35, 36, so that the closing procedure takes place rapidly in an undamped manner.

With the embodiment of an injection nozzle according to FIG. 4, a multiplicity of opportunities is provided for modulating and optimizing the courses of injection and thereby for optimizing engine characteristics. Instead of the magnetic coupling of the supplementary masses, a mechanical coupling may also be provided. However, a clearly pronounced magnetic separating force has the advantage that it furnishes supplementary braking pulses. The free stroke between the valve needle 14 of the coupler 40 supplies a supplementary modulation of the course of injection.

Figure 6:
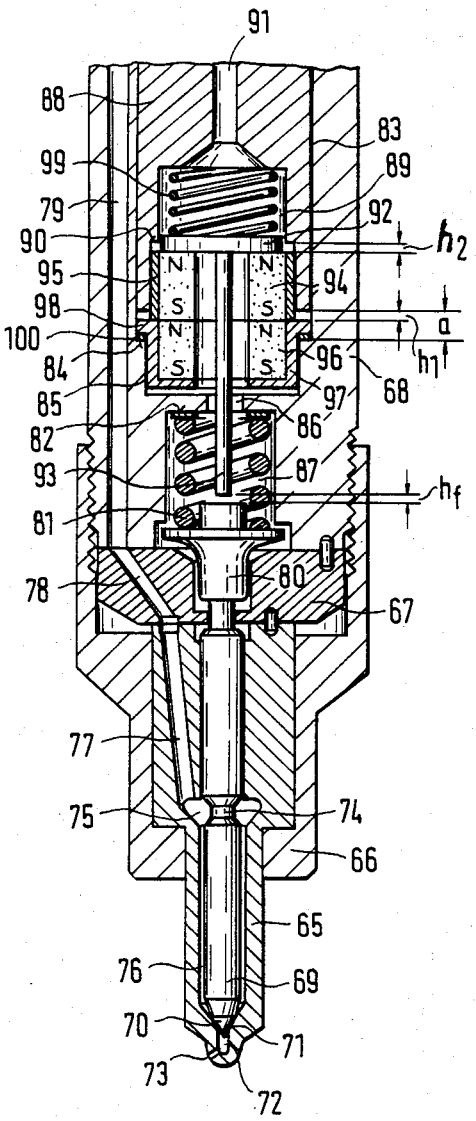
FIG. 6 shows the third exemplary embodiment in section.

The exemplary embodiments described above relate to injection nozzles having a valve needle opening outward (A-type nozzles). The disposition in accordance with the invention of supplementary masses which may be uncoupled during the opening stroke may equally advantageously be applied, however, to injection nozzles having inwardly opening valve needles. In FIG. 6 an injection nozzle of this kind is shown.

The injection nozzle of FIG. 6 has a nozzle body 65, which is fastened against a nozzle holder 68 by a sleeve nut 66, with an intervening disk 67. A valve needle 69 is displaceably supported in the nozzle body 65 and has a sealing cone 70, which cooperates with an inwardly directed valve seat 71 of the nozzle body 65. Adjacent to the valve seat 71 is a blind bore 72, from whence a nozzle bore 73 leads to the outside.

Approximately in the middle of its length, the nozzle needle 69 has an annular groove 74, which is surrounded by a pressure chamber 75 in the nozzle body 64. The section of the valve needle 69 located above the annular groove 75 is guided in a tightly-fitting manner in the nozzle body 65, while in contrast the needle section located below the annular groove 74 has a smaller diameter than does the inner bore of the nozzle body 65 and with its wall, it defines an annular chamber 76 leading to the valve seat. The pressure chamber 75 communicates via bores 77, 78 and 79 in the nozzle body 65, the disk 67, and the nozzle holder 68 with a connection fitting (not visible in the drawing) of the nozzle holder 68. Seated on the upper end of the valve needle 69, is a pressure piece 80, which is engaged by a closing spring 81, which is supported on a shoulder 82 attached to the housing of the nozzle holder 68 and presses the valve needle 69 against the valve seat 61. A bore 83 is formed in the nozzle holder 68 and the bore 83 merges at an annular shoulder 84 with a narrowed bore section 85, which communicates via a central passage 86 with a chamber 87 receiving the closing spring 81. A rotationally symmetrical body 88 is placed from above into the bore 83 in such a manner that the lower end of the body 88 is at a distance a from the shoulder 84. The body 88 is likewise provided with a stepped bore 89, the two bore sections are of different sizes and are separated from one another by a shoulder 90. From the bore 89, a leakage oil bore 91 leads to a leakage oil connection, not shown in the drawing, of the injection nozzle.

A disk 92 of soft iron is displaceably guided in the bore 89 and firmly connected with a push rod 93, which protrudes all the way through the passage 86 and on into the chamber 87. An annular permanent magnet body 94 adheres to the underside of the disk 92 and is fastened in a sheath 95 which is displaceably guided in the outer section of the bore 89 in the body 88. Adhering to the permanent magnet body 94 is a second permanent magnet body 96, which is fastened in a sheath 97 displaceably guided in the bore section 85 of the nozzle holder 68. The sheath 97 has a flange 98, which engages the bore 83 of the nozzle holder 68 and is pressed by a compression spring 99 in the bore 89, via the disk 92 and two permanent magnet bodies 94 and 96, against a damping disk 100 resting on the shoulder 84. In this position of the various elements, the lower end of the push rod 33 is remote by the dimension $h_f$ from the upper end of the pressure piece 80. Furthermore, the flange 98 of sheath 97 is at a distance $h_1$, in this position, from the lower end of the body 88, while the upper end rim of the sheath 95 is at a distance $h_2$ from the shoulder 90.

The two permanent magnet bodies 94 and 96 represent the supplementary bodies of the injection nozzle, which by reason of their mass effect, the opening movement of the valve needle 69 during a first and second stroke portion has an acceleration-dependent damping. In this embodiment as well, the valve needle 69, at first, executes an idle stroke $h_f$, until the two supplementary masses 94 and 96 are coupled to the valve needle and then effect the damping. The two permanent magnet bodies 94 and 96 are carried upward with the valve needle 69 via the push rod 93 and the disk 92, until following a further stroke portion $h_1$, the sheath 97 comes to rest on the body 88 and the lower permanent magnet body 96 is uncoupled. Following a further stroke portion of the valve needle, having the length $h_2-h_1$, the upper permanent magnet body 94 is also blocked at the shoulder 90, and it is uncoupled from the valve needle 69 once its holding force has been overcome; from this time on, the fuel pressure prevailing in the pressure chamber 75 and exerted upon the pressure shoulder of the valve needle 69 rapidly moves the valve needle back into its completely open position. Upon the closure of the valve, the permanent magnet bodies 94 and 96 are coupled in reverse order, and here again the valve needle is uncoupled from these supplementary masses and is capable of advancing more rapidly into the closed position.

The injection nozzle of FIG. 7 has a valve assembly 102 which agrees with the valve assembly shown in FIG. 1 and described in connection therewith. Above the valve assembly 102, a supplementary body 104 having increased mass is displaceably guided in a bushing 103, the supplementary body comprising a permanent magnet body 105 having a flat shape and two segment-like pole shoes 106 of soft iron secured to its flat sides. These elements together form a magnet, the armature of which is the support disk 17 for the closing spring 18 of the valve needle 14. A helical spring 110 acts upon the supplementary body 104 via a sheath 108 of nonmagnetic material, the helical spring 110 supporting itself on a shoulder 111 of the bushing 103 and pressing the supplementary body 105 against a shoulder 113 of the nozzle holder via an adjusting ring 112 of nonmagnetic material. The supplementary body 104 includes a plurality of longitudinal bores 114, which connect an inflow bore 115 with the chamber 22 receiving the closing spring 18 and the helical spring 110.

Figure 7:
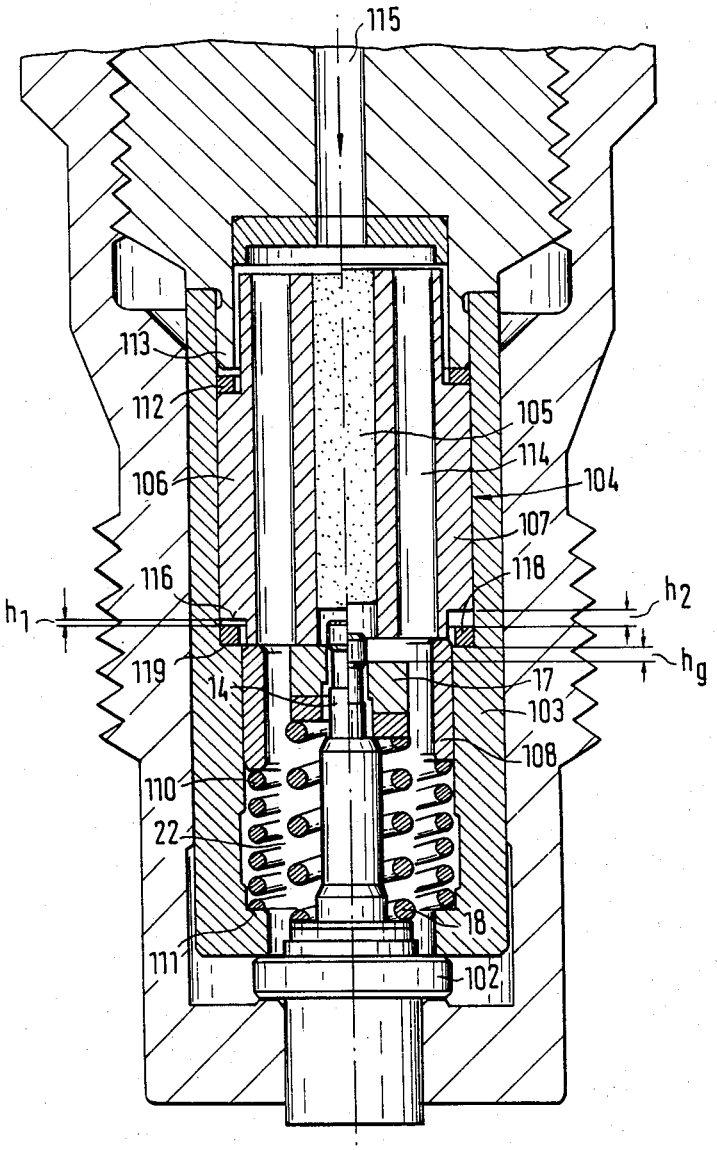
FIG. 7 shows the fourth exemplary embodiment in section.

In the closing position of the valve needle 14 shown at the left of FIG. 7, the magnetic attracting force prevailing between the support disk 17 of the supplementary body 104 overcomes the counteracting force of the closing spring 110, so that the supplementary body 104 rests on the support disk 17. In this position, an annular shoulder 116 of the supplementary body 104 is remote from a counterpart shoulder attached to the housing by the dimension $h_1$, the counterpart shoulder being formed at an adjusting ring 118 of nonmagnetizable material, which is supported on a shoulder 119 of the bushing 103. When at the beginning of an injection procedure the increasing fuel pressure overcomes the counteracting forces of the springs 18 and 110, the valve needle 14 and with it the supplementary body 104 are moved downward, until at the end of the stroke portion $h_1$ the until at the end of the stroke portion $h_1$ the supplementary body 104 comes to rest on the adjusting ring 118. The mass of the supplementary body 104 retards this first movement phase of the valve needle in the manner desired for the sake of an optimal course of injection.

Directly following the arrival of the supplementary body 104 upon the adjusting ring 118, the valve needle 14, exposed to the fuel pressure, is released from the supplementary body 104, which results in a jump in force. The magnetic force thereupon decreases in a digressive manner with the needle stroke, so that following a braking of the impact, a rapid relief of the supplementary force acting upon the valve needle 14 takes place. The steepness of inclination of the main injection is favorably influenced thereby. If the magnetic force has decreased by a predetermined value in the course of the needle stroke, the helical spring 110 is capable of returning the supplementary body 104, counter to the needle movement, by the distance $h_2$, as the result of which the magnetic force is weakened further. By the appropriate selection of the adjusting rings 112 and 118, the play values $h_1$ and $h_2$ of the movement of the supplementary body 104 are optimally adapted to a given application. In the fully opened position, the valve needle 14 assumes the position shown on the right-hand side of FIG. 7, in which the upper in which the upper side of the support disk 17 is at a distance $h_g$ from the annular shoulder 119 on the bushing 103. The closing movement of the valve needle 14 is effected at increasing magnetic force, and after a predetermined return stroke the supplementary body 104 is again attracted toward the adjusting ring 118. This in turn causes a jump in force, in consequence of which the closing movement is accelerated still further. Shortly before the closure of the valve, the support disk 17 strikes the supplementary body 104. The valve needle 14 is thereby braked, so that it assumes its seat on the valve seat in a damped manner. In rare cases, the support disk 17 can bounce back and interrupt the exertion of closing force. In such cases, a small initial air gap is provided between the magnetic system of the supplementary body 104 and the support disk 17. The supplementary body 104 can then be advantageously supported directly on the end face side of the nozzle needle 14.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines, having a housing, a nozzle body in said housing, said nozzle body having a valve seat, and a displaceably guided valve closing member, said member being acted upon by a closing spring and capable of being urged counter thereto by a fuel pressure, and a supplementary body coupled with the valve closing member at the end of a first partial stroke thereof and together with a shoulder integral with the housing is arranged to effect an abrupt change in the course of the opening pressure, characterized in that said supplementary body at the end of the first partial stroke, is also coupled with said shoulder integral with said said housing, means for magnetically coupling between said supplementary body and said valve closing member and said shoulder via a magnetic force which exerts a holding force counteracting the fuel pressure applied to said valve closing member, said holding force being smaller than the maximum displacement force exerted by the fuel pressure upon said valve closing member, and that the elements are embodied and disposed such that after overcoming the magnetic coupling or holding force, the supplementary body tears away from its magnetic counterpart, i.e., said valve closing member and said shoulder, and the valve closing member is capable of moving onward to its fully open position.

2. An injection nozzle as defined by claim 1, further wherein said supplementary body is magnetically coupled by a magnetic force with said valve closing member and at the end of the first partial stroke of said valve closing member, said member comes to rest on the shoulder integral with said housing.

3. An injection nozzle as claimed in claim 1, characterized in that said supplementary body is movable within a cylinder chamber filled with fuel, said cylinder chamber having portions which are located at either side of the supplementary body and communicate with one another via a throttling conduit.

4. An injection nozzle as defined in claim 1, characterized in that the magnetic force is brought about by a permanent magnet body.

5. An injection nozzle as defined by claim 4, characterized in that at least a part of said supplementary body is itself embodied as a permanent magnet body.

6. An injection nozzle as defined in claim 4, characterized in that said permanent magnet body is positioned in close proximity to said valve closing member.

7. An injection nozzle as claimed in claim 6, characterized in that said supplementary body is movable within a cylinder chamber filled with fuel, said cylinder chamber having portions which are located at either side of the supplementary body and communicate with one another via a throttling conduit.

8. An injection nozzle as defined by claim 1, characterized in that said supplementary body is under the influence of a restoring spring, which returns said supplementary body back to a stop attached to a nozzle holder following the separation from said valve closing member which is moved further.

9. An injection nozzle as defined by claim 8, characterized in that said stop attached to the nozzle holder holds said supplementary body firmly in an intercepting position located still further behind its initial position, and in this intercepting position the magnetic force is still capable of attracting said supplementary body into the initial position.

10. An injection nozzle as claimed in claim 1, 4, 5, 6, 3, 7, 8, or 9, characterized in that an initial air gap is present in the magnetic means, the air gap magnetically coupling said supplementary body with the valve closing member in a positively-engaged manner.

11. An injection nozzle as defined by claim 1, 4, 5, 6, 3 or 7, characterized in that a throttling conduit is formed by correspondingly narrowly dimensioned guide gaps in said supplementary body within the cylinder chamber.

12. An injection nozzle as claimed in claim 1, 4, 5, 6, 3 or 7, characterized in that said supplementary body has a mass which notably influences forces of acceleration or retardation of said valve closing member.

13. An injection nozzle as claimed in claim 1, 4, 5, 6, 3 or 7, including a plurality of supplementary bodies, which upon an opening stroke of said valve closing member come to rest one after another in the course of time on shoulders attached to said nozzle body.

14. An injection nozzle as claimed in claims 1, 4, 5, 6, 3 or 7, wherein said supplementary body is held firmly on a coupler which is magnetically coupled in turn with the valve closing member via a spacing ($h_j$) which executes an idle stroke.

* * * * *